US007712607B2

(12) United States Patent
Ghini et al.

(10) Patent No.: US 7,712,607 B2
(45) Date of Patent: May 11, 2010

(54) RIGID SWING-OPEN PACKET OF CIGARETTES

(75) Inventors: Marco Ghini, Monte San Pietro (IT); Roberto Polloni, Modigliana (IT); Stefano Negrini, Calderara Di Reno (IT)

(73) Assignee: G.D Societ a'per Azioni, Bologna (IT)

( * ) Notice: Subject to any disclaimer, the term of this patent is extended or adjusted under 35 U.S.C. 154(b) by 50 days.

(21) Appl. No.: 12/172,643

(22) Filed: Jul. 14, 2008

(65) Prior Publication Data

US 2009/0038966 A1 Feb. 12, 2009

(30) Foreign Application Priority Data

Jul. 17, 2007 (IT) ..... BO2007A0480
Mar. 31, 2008 (EP) ..... 08153811

(51) Int. Cl.
*B65D 85/12* (2006.01)

(52) U.S. Cl. ..... 206/268; 206/261; 206/242

(58) Field of Classification Search ..... 206/256, 206/257, 261, 268, 271, 242; 229/120.1, 229/120.01, 122, 123
See application file for complete search history.

(56) References Cited

U.S. PATENT DOCUMENTS 3,007,623 A * 11/1961 Clemens ..... 229/120.03
3,052,398 A * 9/1962 Benjamin ..... 229/125.37
5,174,492 A * 12/1992 Gero ..... 229/123
7,617,930 B2 * 11/2009 Jones et al. ..... 206/256
2009/0045084 A1 * 2/2009 Roila et al. ..... 206/268

FOREIGN PATENT DOCUMENTS

| | | |
|---|---|---|
| CH | 339 117 | 6/1959 |
| EP | 1 927 551 | 6/2008 |
| WO | WO-03/053818 | 7/2003 |
| WO | WO-03/080473 | 10/2003 |
| WO | WO-2005/102846 | 11/2005 |

OTHER PUBLICATIONS

European Search Report in EP 08 15 3811 dated Sep. 4, 2008.

* cited by examiner

*Primary Examiner*—J. Gregory Pickett
*Assistant Examiner*—Kaushikkumar Desai
(74) *Attorney, Agent, or Firm*—Marshall, Gerstein & Borun LLP

(57) ABSTRACT

A rigid, swing-open packet of cigarettes having: at least one group of cigarettes; at least one inner container housing the group of cigarettes; an outer container housing the inner container and having at least one open lateral end; and a hinge connecting the inner container and the outer container to allow the inner container to rotate between a closed position, in which the inner container is inserted inside the outer container, and an open position, in which the inner container is at least partly extracted from the outer container; the hinge being located close to an edge of a wall of the inner container and close to an edge of a bottom wall of the outer container at the open lateral end of the outer container.

29 Claims, 20 Drawing Sheets

RIGID SWING-OPEN PACKET OF CIGARETTES

CROSS-REFERENCE TO RELATED APPLICATIONS

This application claims the benefit of European patent application No. 08153811.8, filed Mar. 31, 2008 and Italian patent application No. BO 2007A000480, filed Jul. 17, 2007.

TECHNICAL FIELD

The present invention relates to a rigid swing-open packet of cigarettes.

BACKGROUND ART

Rigid, hinged-lid packets of cigarettes are currently the most widely marketed, by being easy to produce, practical and easy to use, and by effectively protecting the cigarettes inside.

In addition to rigid, hinged-lid packets of cigarettes, rigid slide-open or swing-open packets of cigarettes have been proposed comprising two containers, one inserted in partly removable manner inside the other. In other words, a rigid slide-open or swing-open packet of cigarettes comprises a first container housing a group of cigarettes, and in turn housed inside a second container to move, with respect to the second container, between a closed position, in which the first container is inserted inside the second container, and an open position, in which the first container is extracted from the second container. The movement of the first container with respect to the second container may be either a straight (slide-open) movement, or a rotational (swing-open) movement about a hinge connecting the two containers.

A number of embodiments of rigid, straight slide-open packets of cigarettes are described in FR2499947A1, U.S. Pat. Nos. 4,534,463A1 and 5,080,227A1, and one embodiment of a rigid, swing-open packet of cigarettes is described in WO2006021581.

Known rigid swing-open packets of cigarettes, however, have various drawbacks, by being complicated and expensive to produce, and relatively complicated to open.

DISCLOSURE OF THE INVENTION

It is an object of the present invention to provide a rigid swing-open packet of cigarettes designed to eliminate the aforementioned drawbacks, and which, in particular, is cheap and easy to produce.

According to the present invention, there is provided a rigid swing-open packet of cigarettes as claimed in the attached Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
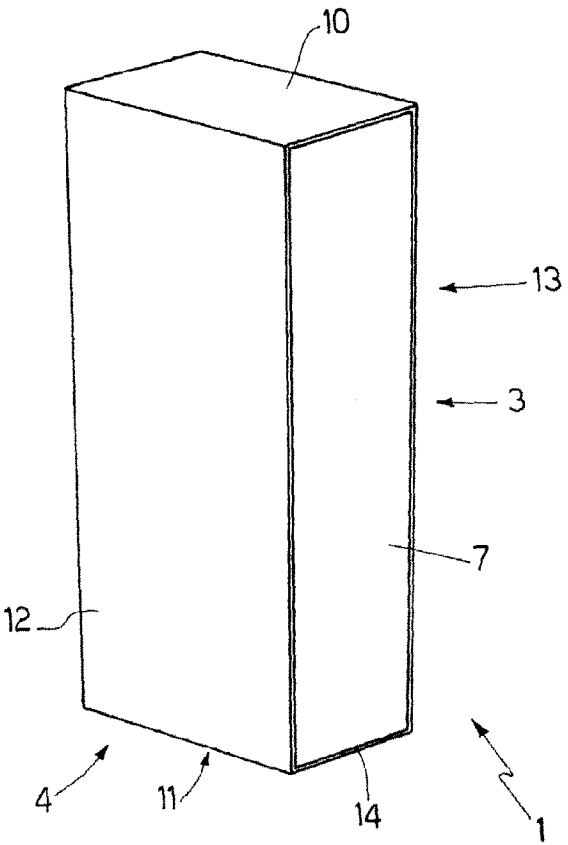
FIG. 1 shows a view in perspective of a rigid, swing-open packet of cigarettes in accordance with the present invention.

Number 1 in FIG. 1 indicates as a whole a rigid swing-open packet of cigarettes.

The FIG. 1 packet 1 of cigarettes comprises two groups 2 of cigarettes (only one shown schematically in FIG. 2); two rigid, parallelepiped-shaped inner containers 3, each housing a group 2 of cigarettes; and a rigid, parallelepiped-shaped outer container 4 housing inner containers 3. Each group 2 of cigarettes is preferably wrapped in a sheet of foil packing material having a tear-off top portion to permit removal of the cigarettes.

Each inner container 3 is hinged to outer container 4 at a hinge 14 to rotate, with respect to outer container 4, between a closed position (FIG. 1), in which inner container 3 is fully inserted inside outer container 4, and an open position (FIG. 2), in which inner container 3 is partly extracted from outer container 4 to allow access to group 2 of cigarettes.

Each inner container 3 is parallelepiped- and cup-shaped, and has an open top end 5 from which the cigarettes are withdrawn; a bottom wall 6 opposite open top end 5; a front wall 7; a rear wall 8 opposite and parallel to front wall 7; and two opposite parallel lateral walls 9.

Outer container 4 is also parallelepiped-shaped, and has a top wall 10; a bottom wall 11 opposite and parallel to top wall 10; two opposite parallel lateral walls 12; and two opposite open lateral ends 13, through each of which an inner container 3 is extracted from or inserted into outer container 4 into the open or closed position respectively.

Each inner container 3 is hinged to outer container 4 by a hinge 14 located between an edge of bottom wall 6 of inner container 3 and an edge of bottom wall 11 of outer container 4 at a respective open lateral end 13 of outer container 4.

In a preferred embodiment, rear wall 8 of each container 3 is lower than front wall 7, so that, in the closed position, front wall 7 closes respective open lateral end 13 of outer container 4 completely, and rotation of inner container 3 about hinge 14 and with respect to outer container 4 is not impeded by rear wall 8 interfering with top wall 10 of outer container 4; and the top portion of each lateral wall 9 of each inner container 3 is shaped to connect front wall 7 smoothly to rear wall 8 to compensate for the difference in height.

Packet 1 of cigarettes has stop means for limiting extraction, and preventing excessive extraction, of each inner container 3 from outer container 4, and which, for each inner container 3, comprise two retaining tabs 15 projecting outwards of outer container 4 from lateral walls 9 of inner container 3 and located close to rear wall 8 of inner container 3; and two retaining pockets 16 projecting inwards of outer container 4 from lateral walls 12 of outer container 4 and located close to the relative open end 13 of outer container 4. In actual use, as inner container 3 rotates, about hinge 14 and with respect to outer container 4, from the closed to the open position, each retaining tab 15 engages a respective retaining pocket 16 to arrest extraction of inner container 3.

To open each inner container 3, the user of packet 1 of cigarettes must pull inner container 3 with respect to outer container 4, and must therefore grip outer container 4 with one hand, and inner container 3 with the other. For easy grip of inner containers 3, each inner container 3 may comprise a grip tab (not shown) projecting outwards from a top edge of front wall 7; or each lateral wall 12 of outer container 4 may have a recess (e.g. semicircular) close to each open lateral end 13, so the user of packet 1 of cigarettes can grip and exert pull on lateral walls 9 of each inner container 3; or top wall 10 of outer container 4 may have a recess (e.g. semicircular) close to each open lateral end 13, so the user of packet 1 of cigarettes can grip and exert pull on front wall 7 of each inner container 3; or front wall 7 of each inner container 3 may have a recess (e.g. semicircular) at the top.

Figure 2:
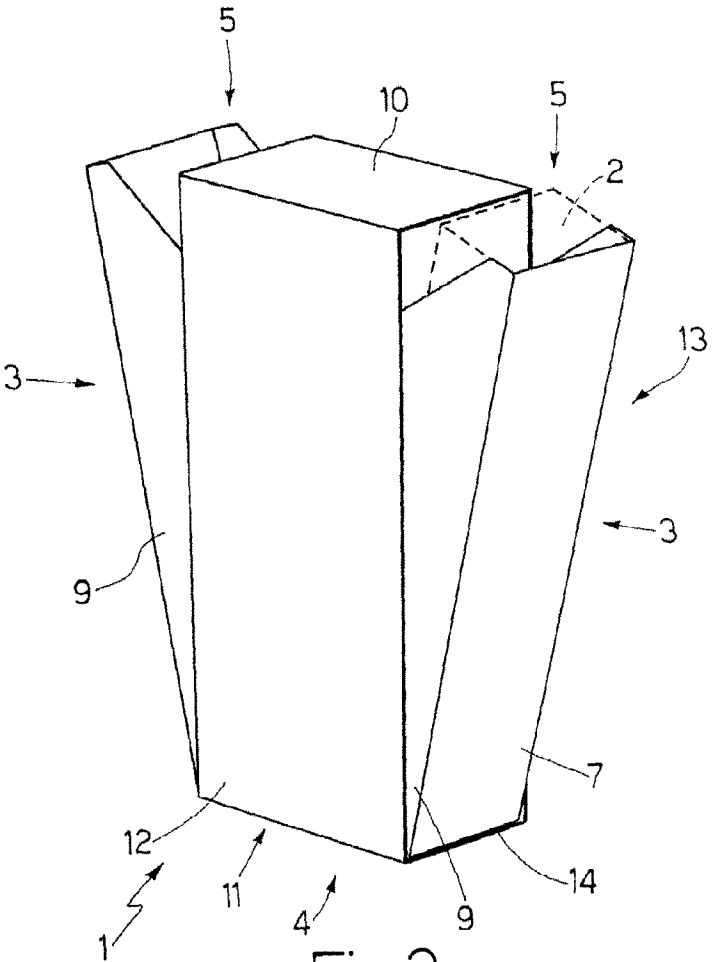
FIG. 2 shows a view in perspective of the FIG. 1 packet of cigarettes in a fully open configuration.
Figure 3:
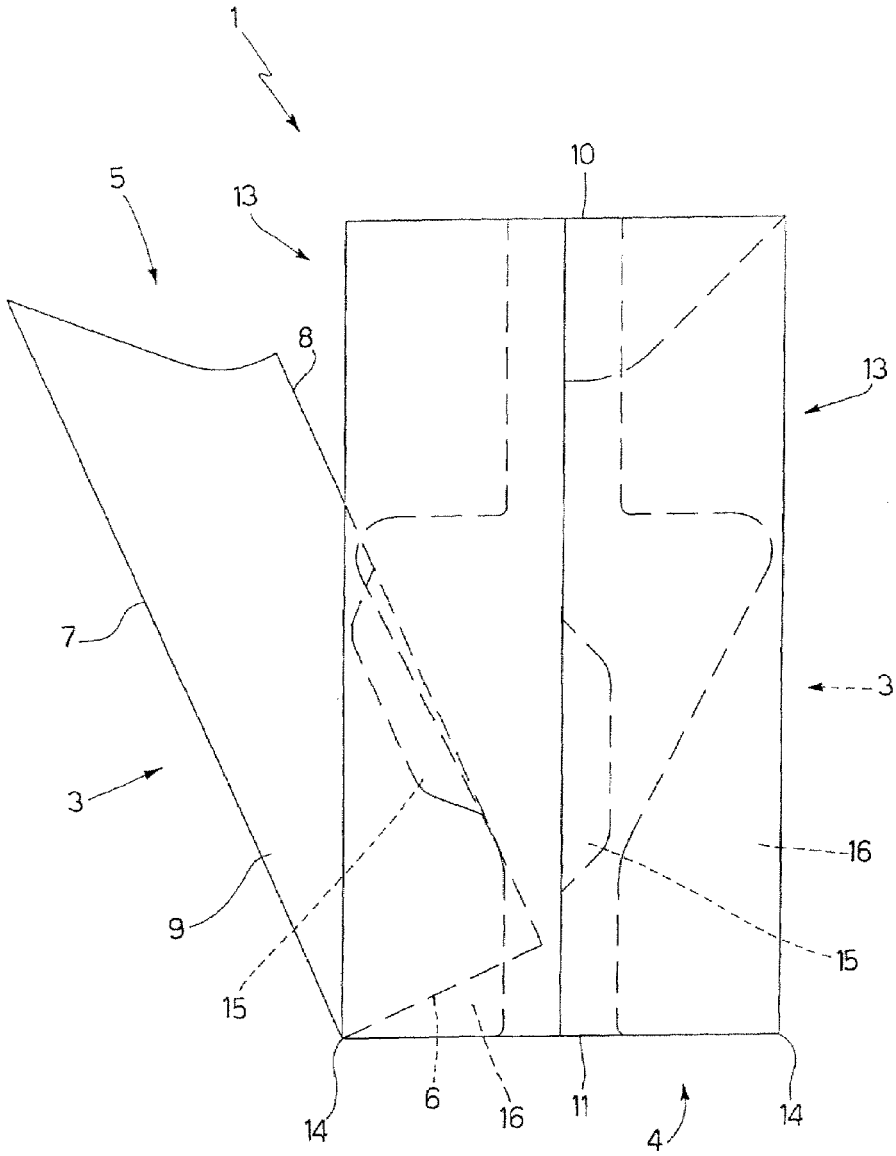
FIG. 3 shows a front view, with parts removed for clarity, of the FIG. 1 packet of cigarettes in a partly open configuration.

In the FIG. 1-3 embodiment, packet 1 of cigarettes comprises two inner containers 3, each housed inside outer container 4 and hinged to outer container 4 along a hinge 14 to rotate between the closed position and the open position. In a different embodiment not shown, packet 1 of cigarettes comprises one inner container 3 housed inside outer container 4 and hinged to outer container 4 along a hinge 14 to rotate between the closed position and the open position; in which case, outer container 4 is half the size of outer container 4 in FIGS. 1-3, and one of the two open lateral ends 13 of outer container 4 is closed by a further lateral wall.

Figure 10:
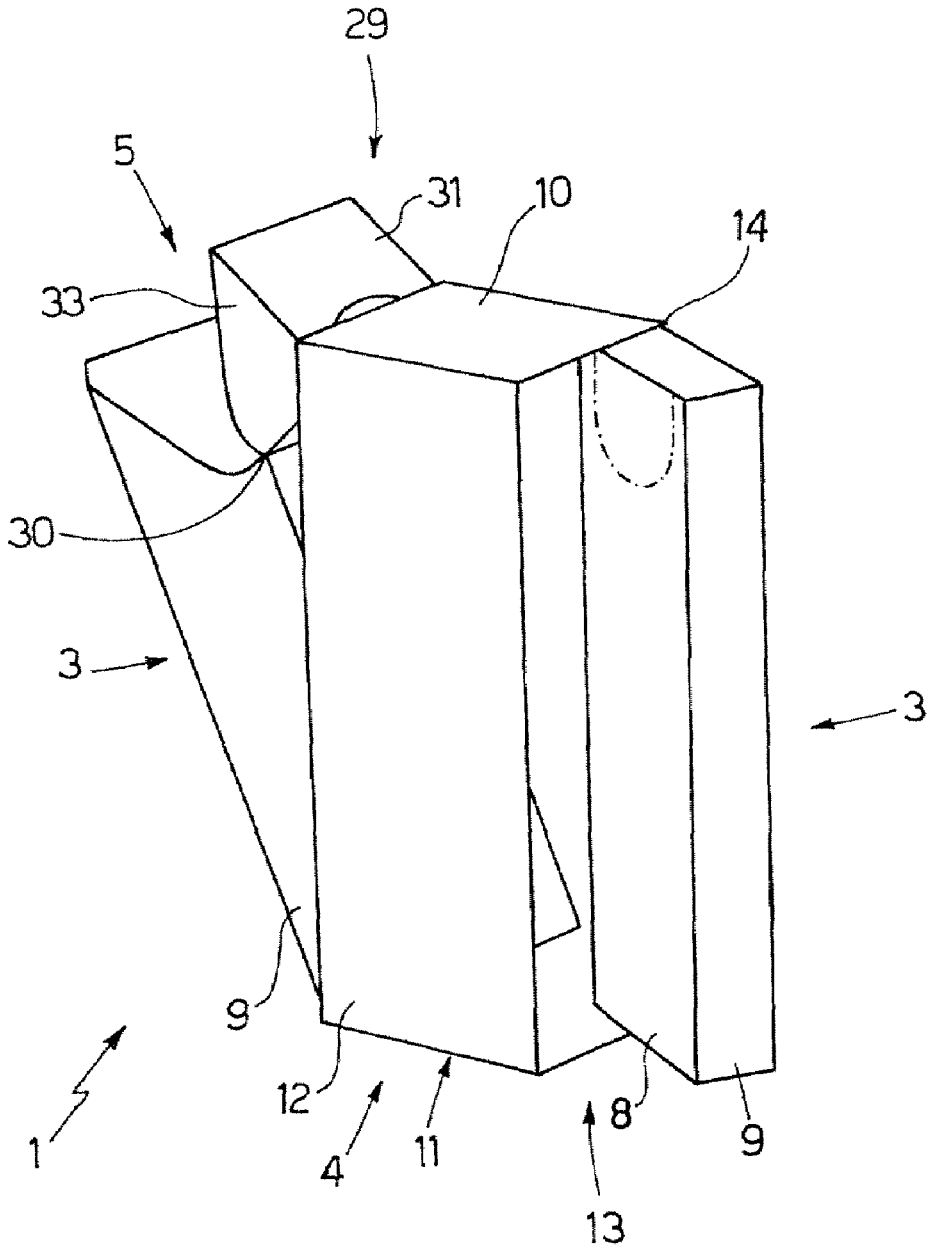
FIG. 10 shows a view in perspective of a further embodiment of the FIG. 1 packet of cigarettes in a fully open configuration.

In the FIGS. 1-3 embodiment, packet 1 of cigarettes comprises two inner containers 3, and two groups 2 of cigarettes, each housed in a respective inner container 3. In a different embodiment shown in FIG. 10, packet 1 of cigarettes comprises one group 2 of cigarettes housed in a main inner container 3*a*, while the other secondary inner container 3*b* houses an accessory (e.g. matches or a lighter) or functions as an ashtray. In this case, the two inner containers 3 may either be identical (as in FIG. 1-3) or different. For example, as shown in FIG. 10, hinge 14 of main inner container 3*a* is located between an edge of bottom wall 6 of main inner container 3*a* and an edge of bottom wall 11 of outer container 4, while hinge 14 of secondary inner container 3*b* is located between an edge of a lateral wall 9 of secondary inner container 3*b* and an edge of a lateral wall 12 of outer container 4.

Figure 4:
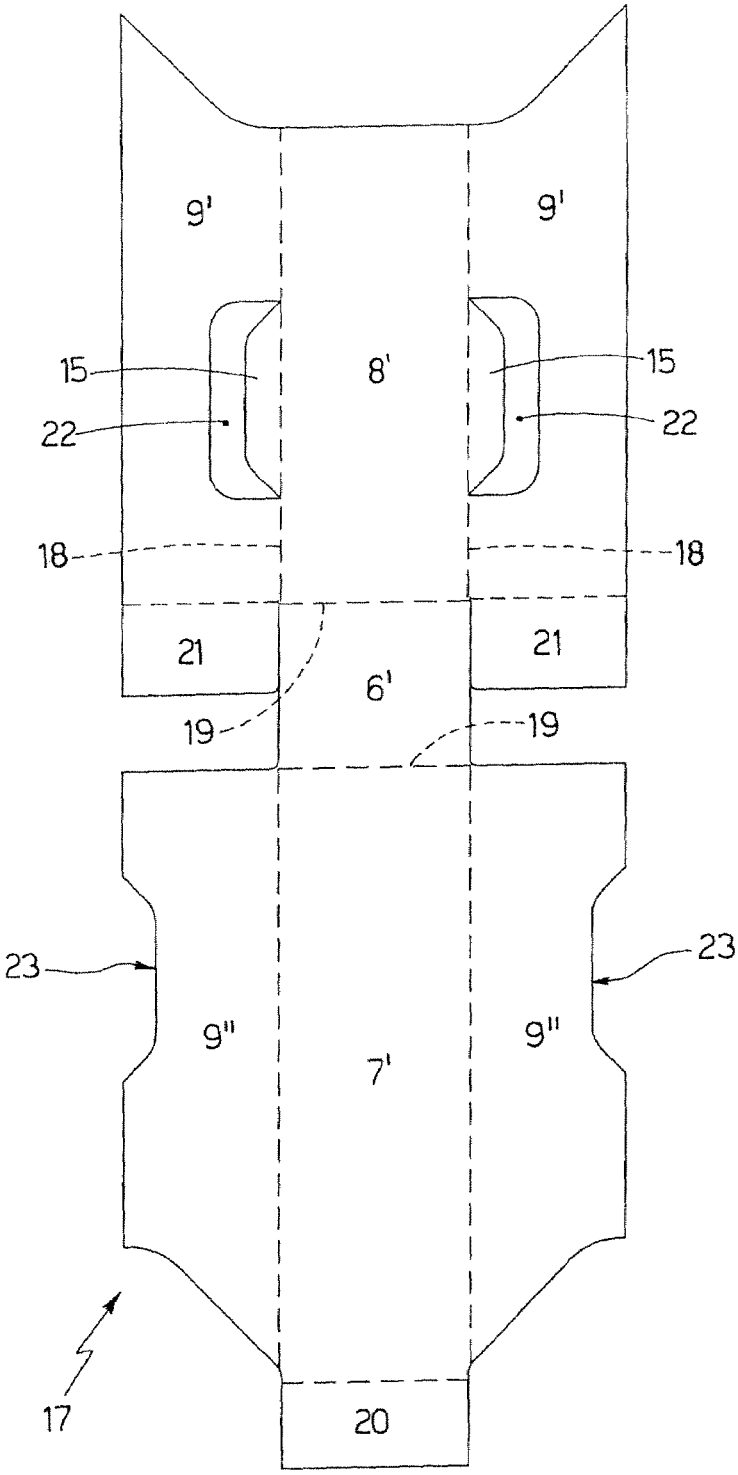
FIG. 4 shows a plan view of a blank from which to form an inner container of the FIG. 1 packet of cigarettes.

As shown in FIG. 4, each inner container 3 is formed by folding a flat, substantially elongated rectangular blank 17, the component parts of which are indicated, where possible, using the same reference numbers, with superscripts, as for the corresponding parts of inner container 3.

Blank 17 has two longitudinal fold lines 18, and a number of transverse fold lines 19 defining, between the two longitudinal fold lines 18, a panel 8' forming rear wall 8; a panel 6' forming bottom wall 6; and a panel 7' forming front wall 7.

Panel 7' has a reinforcing flap 20 connected to panel 7' along a transverse fold line 19, and which is folded 180° onto panel 7' to strengthen the top portion of front wall 7.

Panel 8' has two lateral wings 9', which form respective inner portions of lateral walls 9, are located on opposite sides of panel 8', and are separated from panel 8' by longitudinal fold lines 18. Panel 7' has two lateral wings 9", which form respective outer portions of lateral walls 9, are located on opposite sides of panel 7', and are separated from panel 7' by longitudinal fold lines 18. Each lateral wing 9' of panel 8' has a tab 21 separated from lateral wing 9' by a transverse fold line 19. A window 22 is formed in each lateral wing 9' and contains a respective retaining tab 15. And each lateral wing 9" has a recess 23 located so as to be superimposed over a respective retaining tab 15.

To form inner container 3, panels 7' and 8' are folded 90° with respect to panel 6'; lateral wings 9' are folded 90° with respect to panel 8'; and lateral wings 9" are folded 90° with respect to panel 7' and on top of the folded lateral wings 9'.

Figure 5:
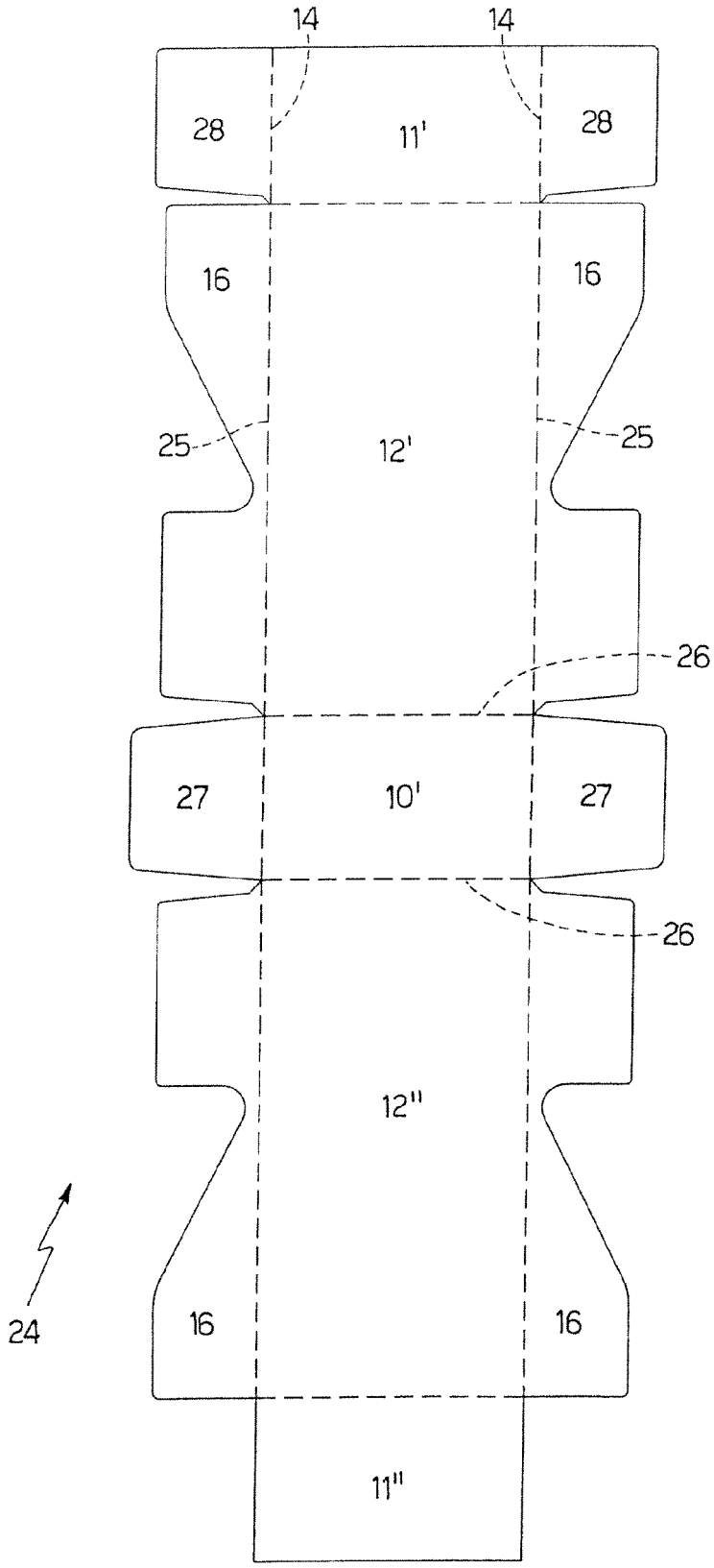
FIG. 5 shows a plan view of a blank from which to form an outer container of the FIG. 1 packet of cigarettes.

As shown in FIG. 5, outer container 4 is formed by folding a flat, substantially elongated rectangular blank 24, the component parts of which are indicated, where possible, using the same reference numbers, with superscripts, as for the corresponding parts of outer container 4.

Blank 24 has two longitudinal fold lines 25, and a number of transverse fold lines 26 defining, between the two longitudinal fold lines 25, a panel 11' forming an inner portion of bottom wall 11; a panel 12' forming one lateral wall 12; a panel 10' forming top wall 10; a panel 12" forming the other lateral wall 12; and a panel 11" forming an outer portion of bottom wall 11.

Panel 10' has two reinforcing flaps 27, which are located on opposite sides of panel 10', are separated from panel 10' by longitudinal fold lines 25, and are folded 180° onto panel 10' to strengthen top wall 10.

Panels 12', 12" each have two retaining pockets 16, which are located on opposite sides of panel 12', 12", are separated from panel 12', 12" by longitudinal fold lines 25, and are folded 180° onto panel 12', 12".

Panel 11' has two connecting tabs 28, which are located on opposite sides of panel 11', are separated from panel 11' by longitudinal fold lines 25, and are folded 180° onto panel 11'. Each connecting tab 28 is glued to bottom wall 6 of a respective inner container 3 to hinge the inner container 3 to outer container 4, so the portion of longitudinal fold line 25 separating each connecting tab 28 from panel 11' forms the hinge 14 of a respective inner container 3.

To form outer container 4, retaining pockets 16 are folded 180° onto relative panels 12', 12"; reinforcing flaps 27 are folded 180° onto panel 10'; connecting tabs 28 are folded 180° onto panel 11'; panels 12', 12" are folded 90° with respect to panel 10'; panel 11' is folded 90° with respect to panel 12'; and panel 11" is folded 90° with respect to panel 12" and on top of the folded panel 11'.

In the FIG. 1-3 embodiment, the open top end 5 of each inner container 3 is left open, i.e. has no covering. In a different embodiment not shown, each inner container 3 comprises a tear-off cover closing open top end 5, connected to the rest of inner container 3 along tear lines, and which is torn off when inner container 3 is unsealed. In the FIGS. 6 and 7 embodiment, each inner container 3 comprises a hinged lid 29 hinged to inner container 3 along a lid hinge 30 to rotate, with respect to inner container 3, between an open position and a closed position opening and closing open top end 5 respectively.

Each lid 29 comprises a rectangular top wall 31 opposite and parallel to bottom wall 6 of inner container 3 when lid 29 is in the closed position; a rectangular rear wall 32 which forms an extension of rear wall 8 of inner container 3 when lid 29 is in the closed position; and two triangular lateral walls 33 which form extensions of lateral walls 9 of inner container 3 when lid 29 is in the closed position. And hinge 30 of each lid 29 connects a top edge of rear wall 8 of inner container 3 to a bottom edge of rear wall 32 of lid 29.

Figure 7:
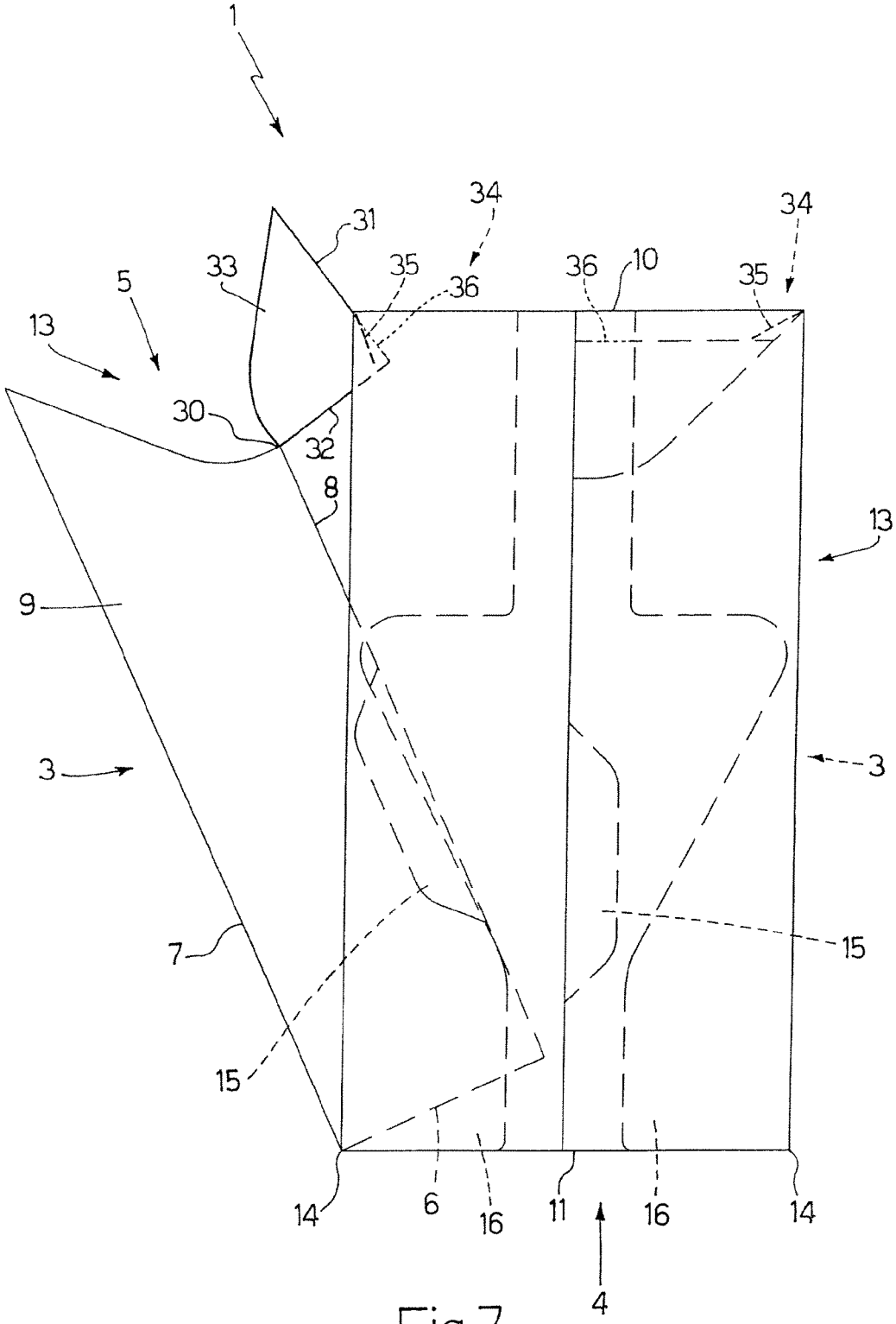
FIG. 7 shows a front view, with parts removed for clarity, of the FIG. 6 packet of cigarettes in a partly open configuration.

In a preferred embodiment, each lid 29 has an actuating system 34 which connects lid 29 to outer container 4 so that, when inner container 3 is extracted from/inserted into outer container 4, lid 29 is connected to outer container 4 to open/close lid 29. By means of actuating system 34, each lid 29 is therefore opened/closed "automatically", with no manual effort on the part of the user, by extracting/inserting inner container 3. As shown in FIG. 7, each actuating system 34 comprises an actuating tab 35 extending inwards of outer container 4 from an edge of top wall 10 of outer container 4; and a slot 36 formed through top wall 31 of lid 29, and which is engaged by actuating tab 35.

Figure 6:
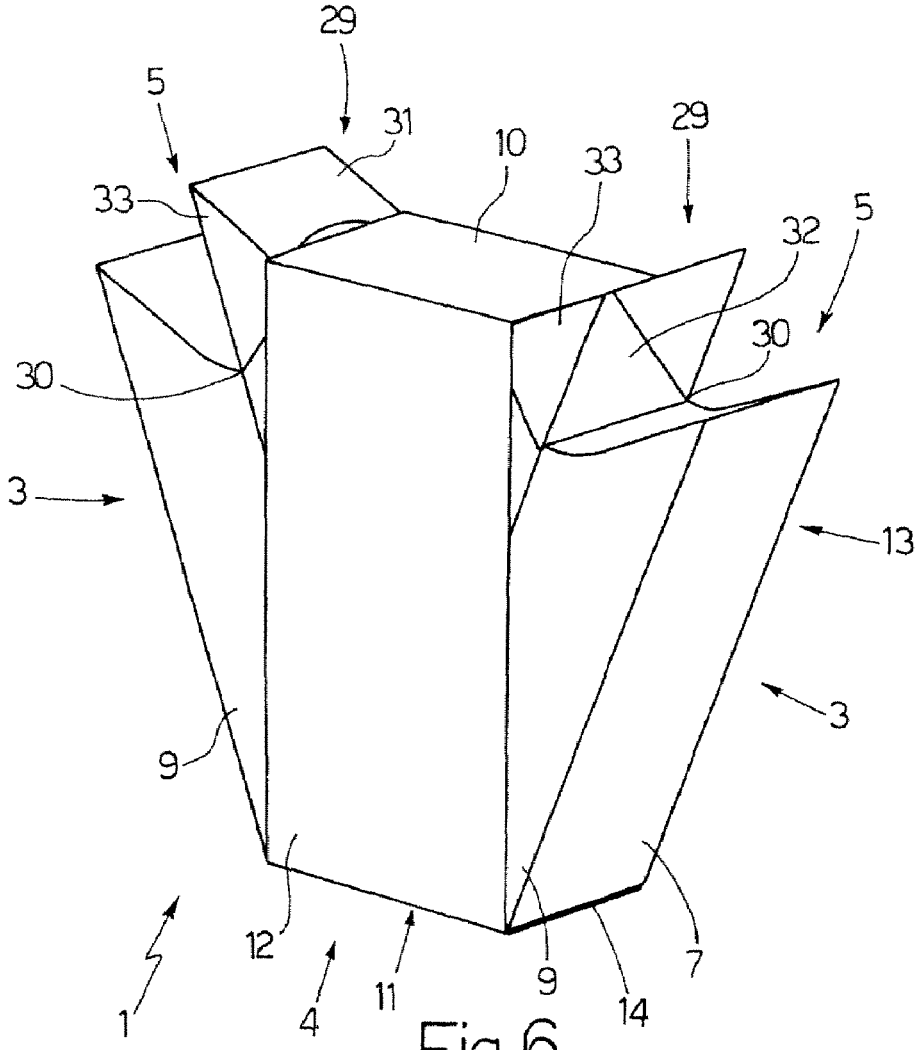
FIG. 6 shows a view in perspective of a different embodiment of the FIG. 1 packet of cigarettes in a fully open configuration.
Figure 8:
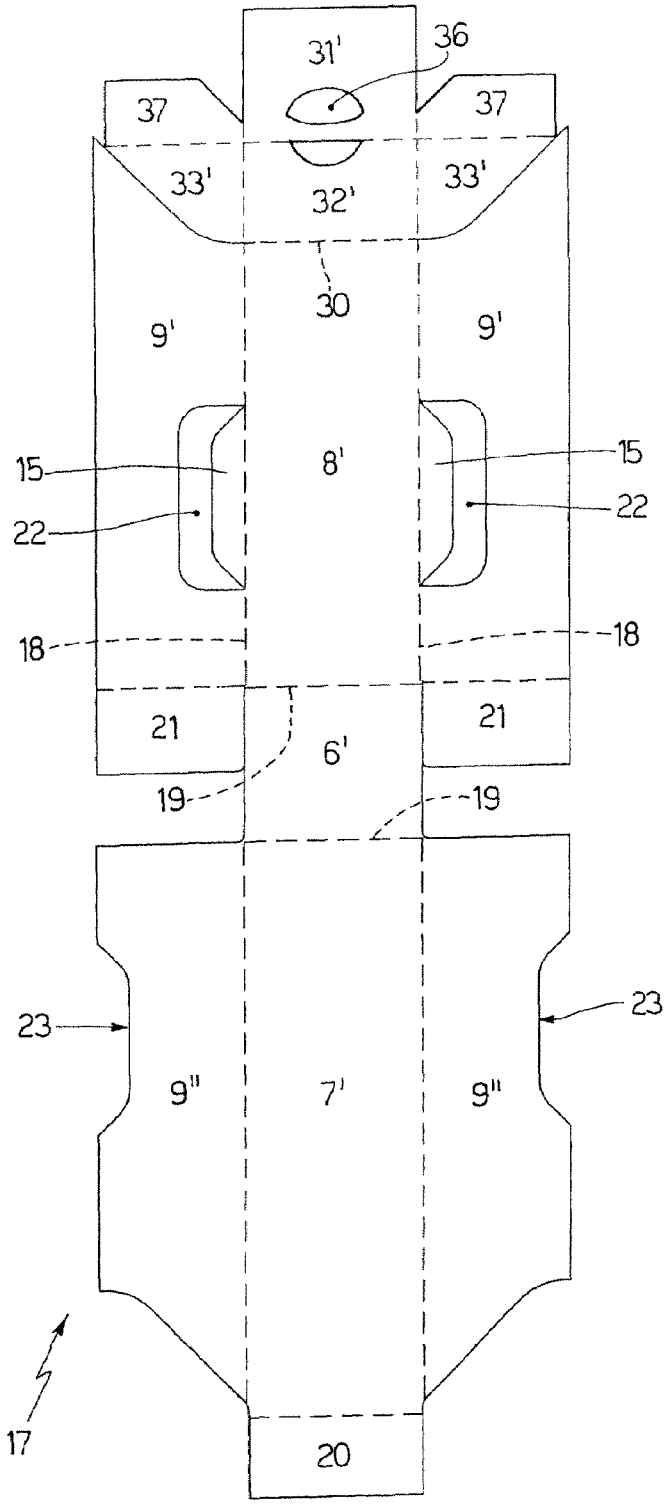
FIG. 8 shows a plan view of a blank from which to form an inner container of the FIG. 6 packet of cigarettes.

FIG. 8 shows a blank 17 from which to form an inner container 3 as shown in FIGS. 6 and 7, i.e. with lid 29. Blank 17 in FIG. 8 differs from the FIG. 4 blank 17 described above by comprising a panel 32' forming rear wall 32 of lid 29; a panel 31' forming top wall 31 of lid 29; and two lateral wings 33' forming lateral walls 33 of lid 29. Each lateral wing 33' has a tab 37, which is folded 90° with respect to lateral wing 33', is fixed to an inner surface of panel 31', and closes slot 36 from the inside. More specifically, each tab 37 has a bevelled corner to leave slot 36 partly open. Tabs 37 assist in holding actuating tab 35, once inserted, inside slot 36. It is important to note that, to insert actuating tab 35 inside slot 36, tabs 37 must flex elastically and so act like springs which press actuating tab 35 against top wall 31 of lid 29.

Figure 9:
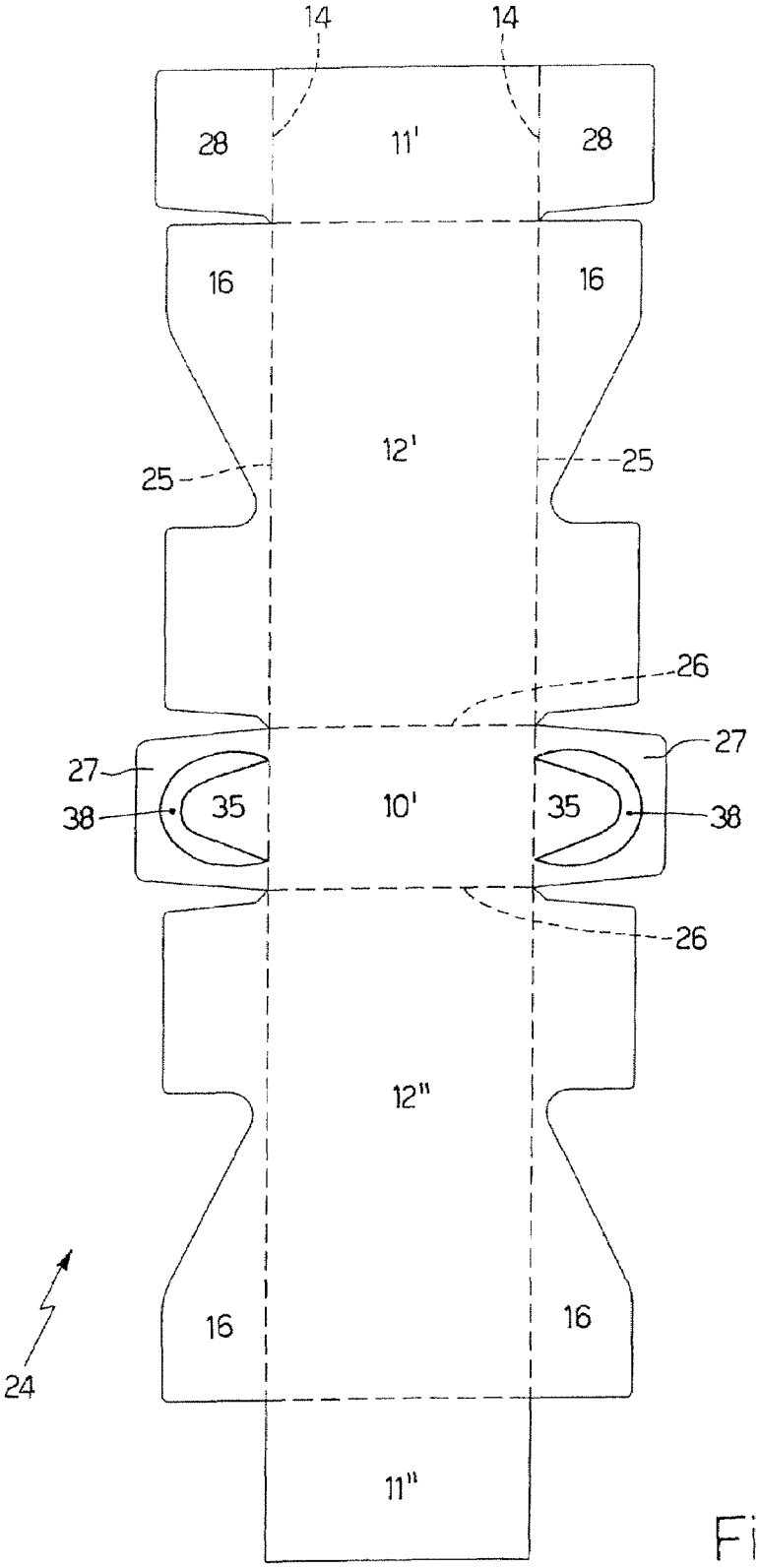
FIG. 9 shows a plan view of a blank from which to form an outer container of the FIG. 6 packet of cigarettes.

FIG. 9 shows a blank 24 from which to form the outer container 4 in FIGS. 6 and 7, i.e. with actuating tabs 35. Unlike the FIG. 5 blank 24 described above, reinforcing flaps 27 of the FIG. 9 blank 24 each have a window 38 in which an actuating tab 35 is formed.

As described above, each inner container 3 is hinged to outer container 4 by a connecting tab 28, which is hinged to outer container 4 along hinge 14 and glued to bottom wall 6 of inner container 3. Each connecting tab 28 is not normally glued to bottom wall 11 of outer container 4, so as to rotate freely with respect to outer container 4. Alternatively, each connecting tab 28 may be glued to bottom wall 11 of outer container 4 using non-setting, re-stick adhesive applied between the bottom surface of connecting tab 28 and the top surface of bottom wall 11 of outer container 4, so connecting tab 28 can be detached repeatedly from bottom wall 11 (i.e. each time inner container 3 is extracted from packet 1 of cigarettes) and then fixed back to bottom wall 11. In one variation, each connecting tab 28 is glued to bottom wall 11 of outer container 4 using weak-stick adhesive which releases its hold the first time inner container 3 is extracted. In another variation, connecting tab 28 is fixed to bottom wall 11 of outer container 4 by a tear line which is torn the first time inner container 3 is extracted. In a different embodiment, as opposed to being hinged to outer container 4 and glued to inner container 3, each connecting tab 28 may be hinged to inner container 3 and glued to outer container 4.

In the FIG. 1-9 embodiments, each hinge 14 is located at an edge of bottom wall 6 of inner container 3 and an edge of bottom wall 11 of outer container 4 at a respective open lateral end 13 of outer container 4. In other words, in the FIG. 1-9 embodiments, each hinge 14 coincides with a bottom transverse edge of inner container 3, and with a bottom transverse edge of outer container 4.

Figure 11:
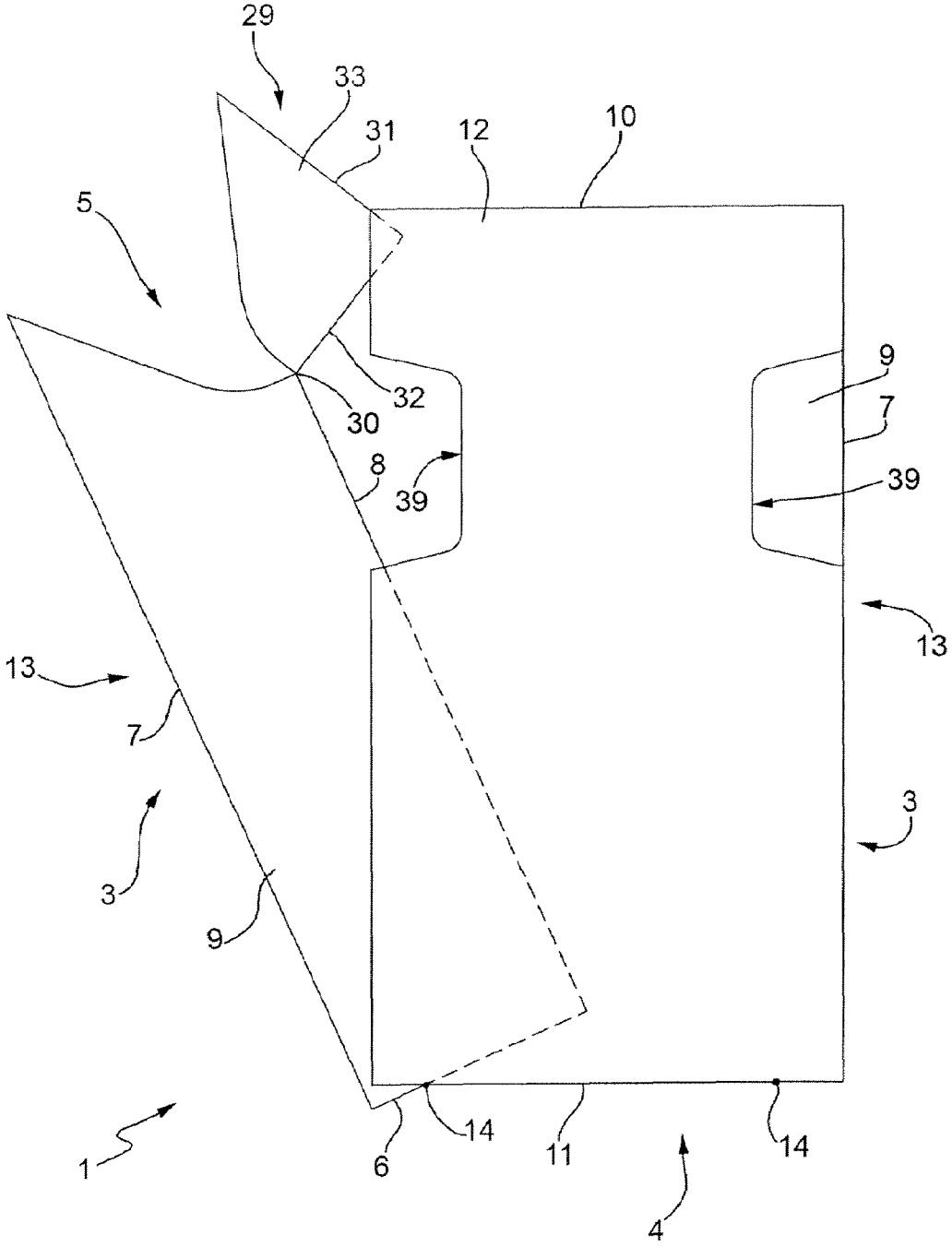
FIG. 11 shows a front view, with parts removed for clarity, of a variation of the FIG. 6 packet of cigarettes in a partly open configuration.

In a different embodiment shown in FIG. 11, each hinge 14 is located a given distance from an edge of bottom wall 6 of inner container 3 and from an edge of bottom wall 11 of outer container 4 at a respective open lateral end 13 of outer container 4. In other words, in the FIG. 11 embodiment, each hinge 14 is located a given distance from a bottom transverse edge of inner container 3 and from a bottom transverse edge of outer container 4, so the two hinges 14 are located closer to the centre (i.e. closer to each other).

Locating the two hinges 14 closer to each other improves extraction of inner containers 3, and reduces the distance between top wall 31 of each lid 29 and top wall 10 of outer container 4 when inner containers 3 are in the closed position. The FIG. 11 embodiment is particularly suitable for tall, narrow packets 1 of cigarettes. Moreover, by locating the two hinges 14 at different distances from the respective edges of bottom wall 6 of inner container 3 and bottom wall 11 of outer container 4, two inner containers 3 of different sizes can be accommodated. Obviously, the larger the inner container 3 is, the greater the distance is between hinge 14 and the respective edges of bottom wall 6 of inner container 3 and bottom wall 11 of outer container 4.

In the FIG. 11 embodiment, each lateral wall 12 of outer container 4 has two recesses 39 exposing the lateral walls 9 of inner containers 3 underneath, and which provide for easy grip of inner containers 3 in the closed position. In other words, the two opposite lateral walls 9 of an inner container 3 in the closed position can be gripped by the user through the two opposite recesses 39 to pull inner container 3 easily into the open position.

Figure 12:
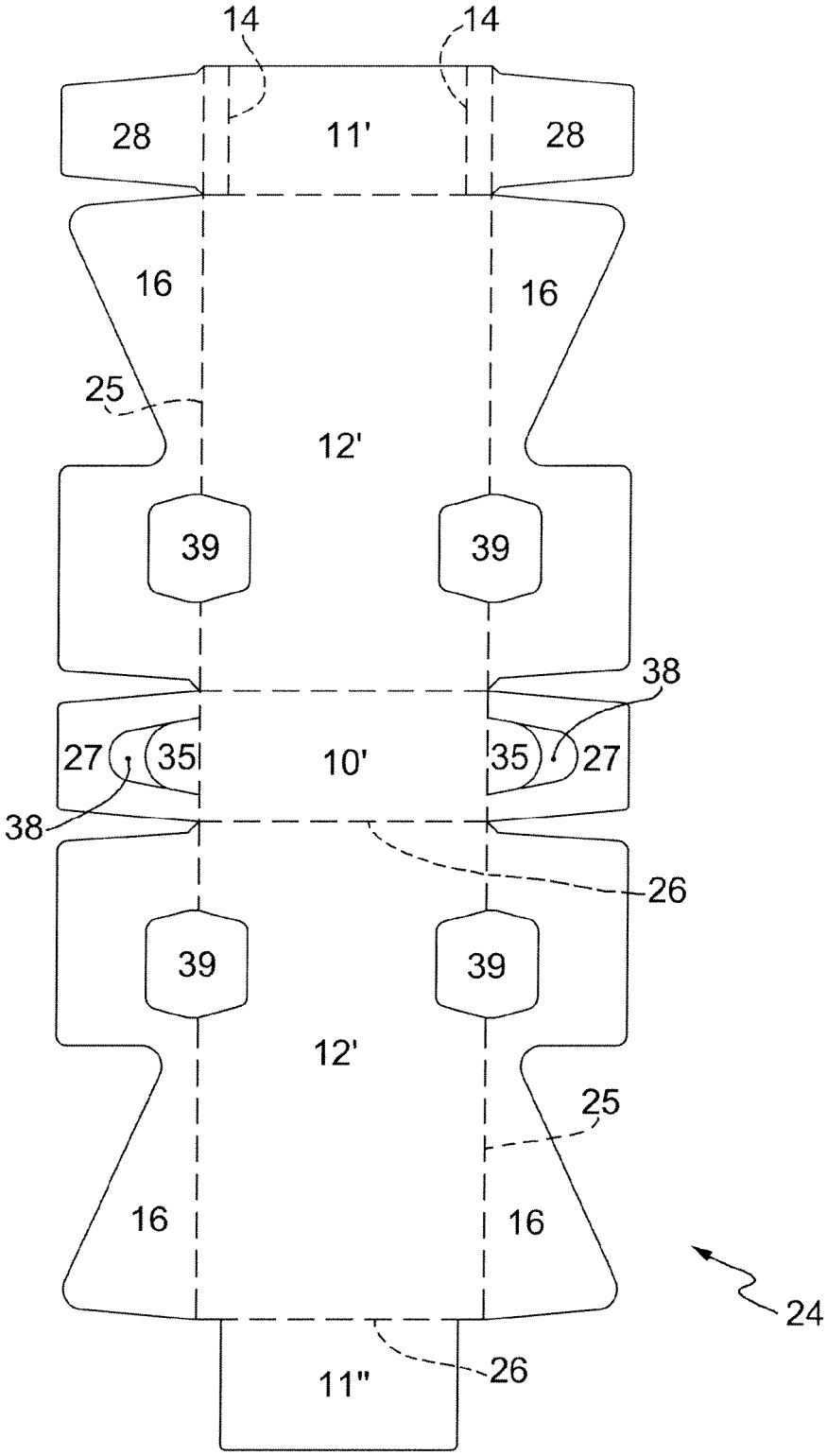
FIG. 12 shows a plan view of a blank from which to form an outer container of the FIG. 11 packet of cigarettes.
Figure 13:
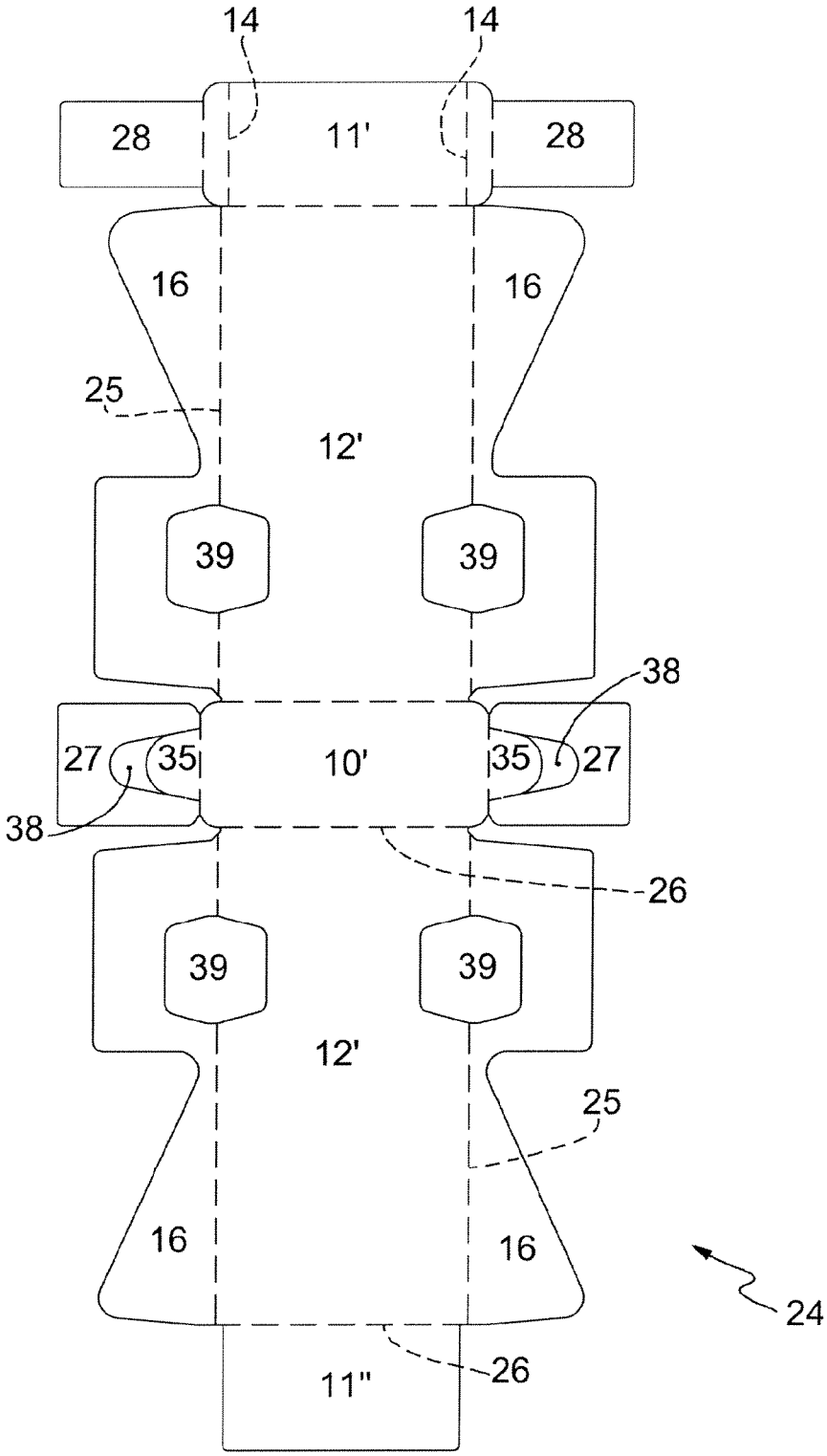
FIGS. 13 and 14 show two variations of the FIG. 12 blank to form an outer container with rounded longitudinal edges.
Figure 14:
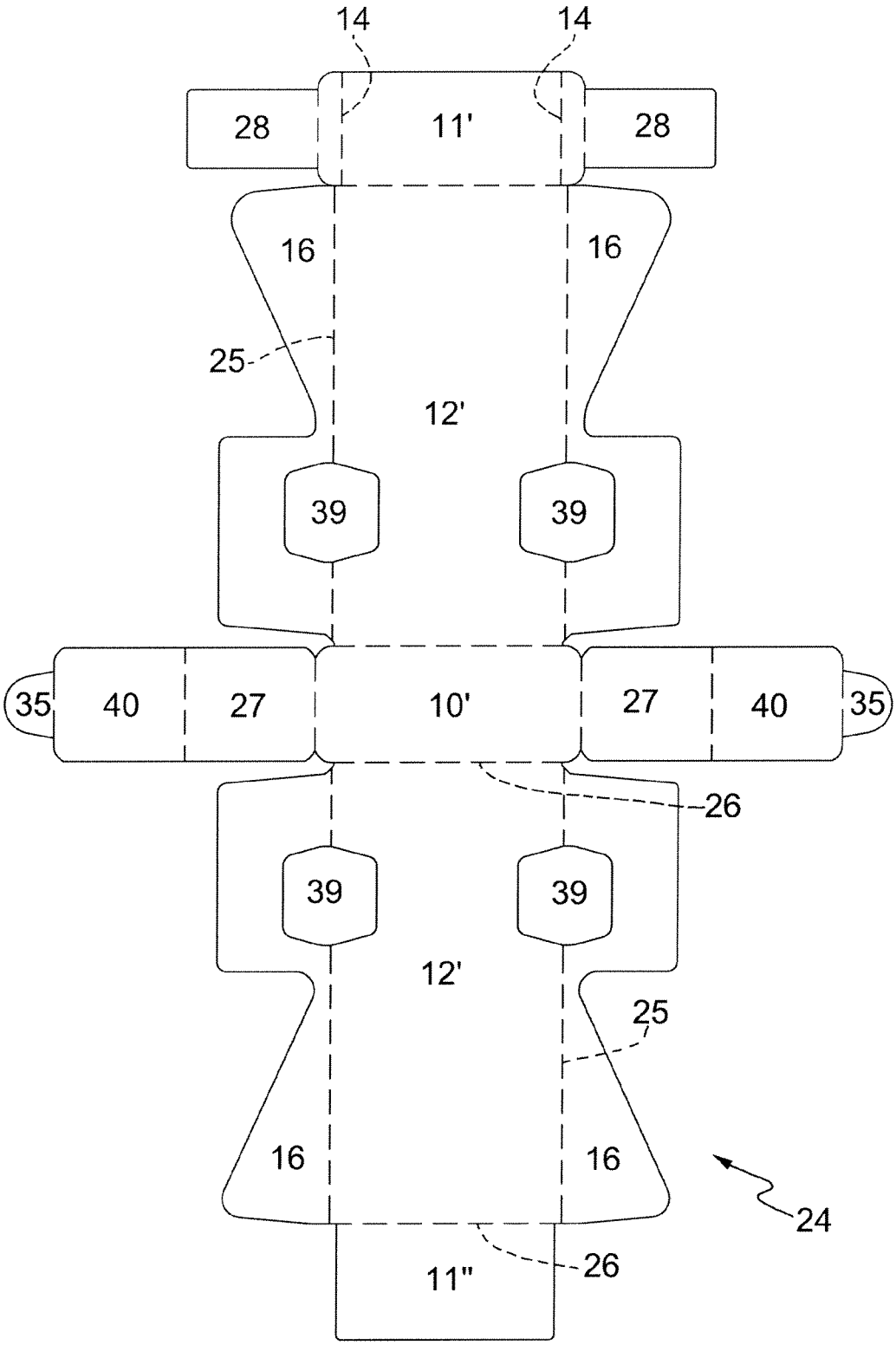
Figure 15:
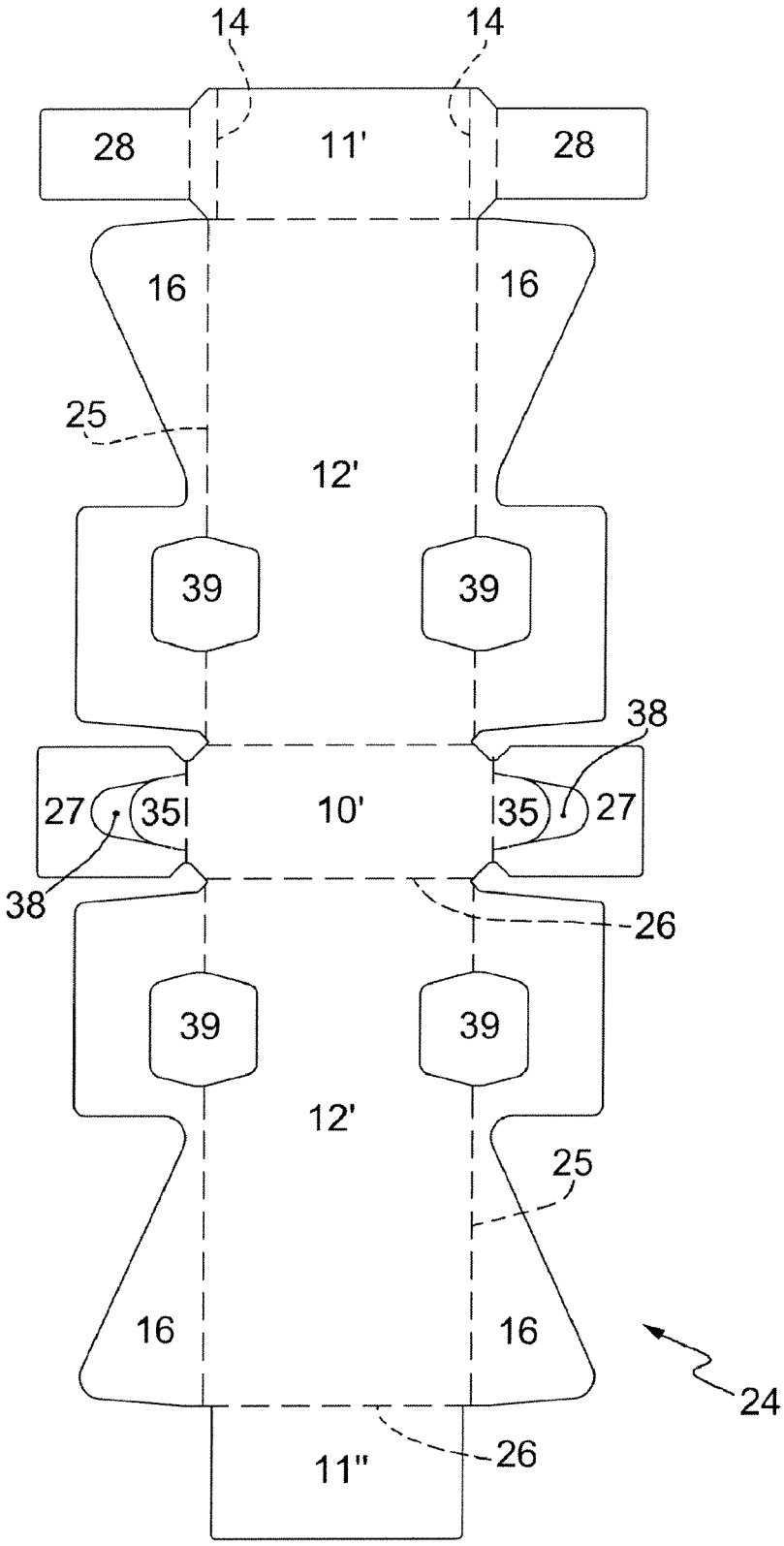
FIG. 15 shows a variation of the FIG. 12 blank to form an outer container with bevelled longitudinal edges.

FIG. 12 shows a flat blank 24 from which to form outer container 4 of the FIG. 11 packet 1 of cigarettes, and the component parts of which are indicated using the same reference numbers as for blank 24 in FIG. 9. FIGS. 13 and 14 show two variations of the FIG. 12 blank 24, to form outer container 4 with rounded longitudinal edges; and FIG. 15 shows a variation of the FIG. 12 blank 24, to form outer container 4 with bevelled longitudinal edges.

In the FIG. 14 variation, panel 10' (forming top wall 10 of outer container 4) has two reinforcing flaps 27, which are located on opposite sides of panel 10', are separated from panel 10' by longitudinal fold lines 25, and are folded 180° onto panel 10' to strengthen top wall 10. Each reinforcing flap 27 has a further reinforcing flap 40, which is separated from reinforcing flap 27 by a longitudinal fold line, and is folded 180° onto reinforcing flap 27 to further strengthen top wall 10. In this embodiment, actuating tabs 35 are connected to reinforcing flaps 40 along longitudinal fold lines. The FIG. 14 variation of blank 24 uses more material, but has the advantage of producing an extremely rigid top wall 10 of outer container 4. Reinforcing flaps 40 in FIG. 14 form part of a blank 24 from which to form an outer container 4 with rounded longitudinal edges, but may obviously also form part of any other embodiment of blank 24, such as that in FIG. 9.

In a different embodiment not shown, packet 1 of cigarettes comprises a retaining member for holding a respective inner container 3 in the closed position with a certain amount of force, and which, for each inner container 3, comprises a deformable member that must be deformed to move the inner container 3 from the closed to the open position. In other words, to move an inner container 3 from the closed to the open position, sufficient force must be exerted on inner container 3 to deform the deformable member elastically. The function of the retaining member is to hold the inner container 3 in the closed position with a certain amount of force, and so prevent inner container 3 from opening accidentally.

Figure 16:
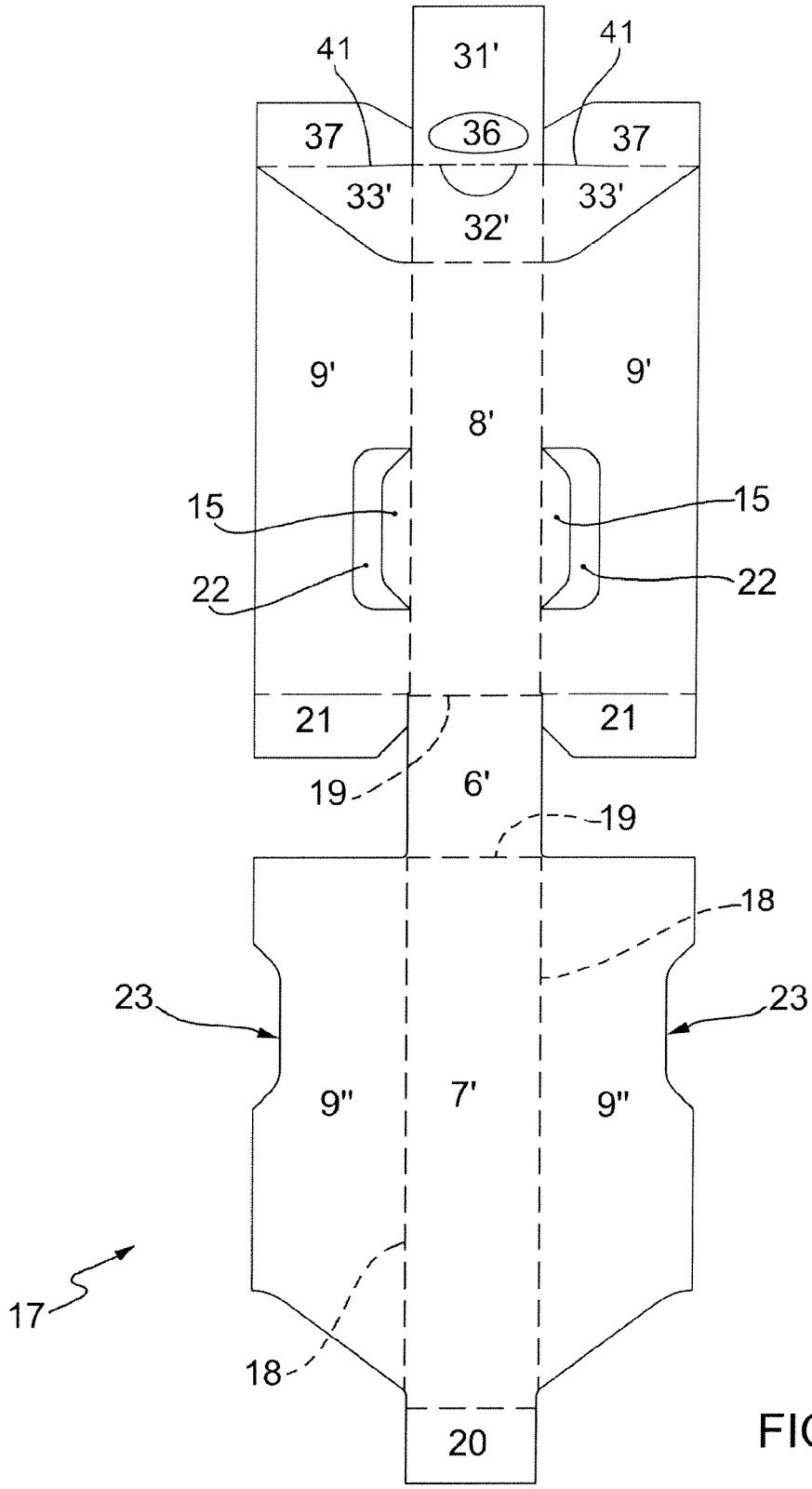
FIGS. 16-19 show plan views of various embodiments of a blank from which to form an inner container of the FIG. 11 packet of cigarettes.

FIG. 16 shows a flat blank 17 from which to form inner container 3 of the FIG. 11 packet 1 of cigarettes, and the component parts of which are indicated using the same reference numbers as for blank 17 in FIG. 8.

The FIG. 16 blank 17 differs from blank 17 in FIG. 8 as to the shape of tabs 21 (perfectly rectangular in FIG. 8, and with a bevelled corner in FIG. 16), and above all as regards tabs 37 of wings 33' forming lateral walls 33 of lid 29. In the FIG. 8 blank 17, each tab 37 is connected to respective wing 33' along a transverse fold line 19 extending the full width of tab 37; whereas, in the FIG. 16 blank 17, each tab 37 is connected to respective wing 33' along a transverse fold line 19 extending along only part (roughly half) of the width of tab 37, in that a cut 41 is also formed between tab 37 and wing 33'.

Each cut 41 provides for a more supple connection of tab 37 and wing 33', so that less force is required to rotate tab 37 with respect to wing 33'. To be inserted inside slot 36, each actuating tab 35 must deform tabs 37, the force required to do which is reduced by cuts 41, thus making it easier to insert actuating tab 35 inside slot 36. It is important to note that tabs 37, on the one hand, oppose insertion of actuating tab 35 inside slot 36, but, on the other, assist in holding actuating tab 35, once inserted, inside slot 36. Cuts 41 provide for achieving just the right elasticity of tabs 37, and which represents the best compromise between allowing insertion of actuating tab 35 inside slot 36, and holding actuating tab 35, once inserted, inside slot 36.

Figure 17:
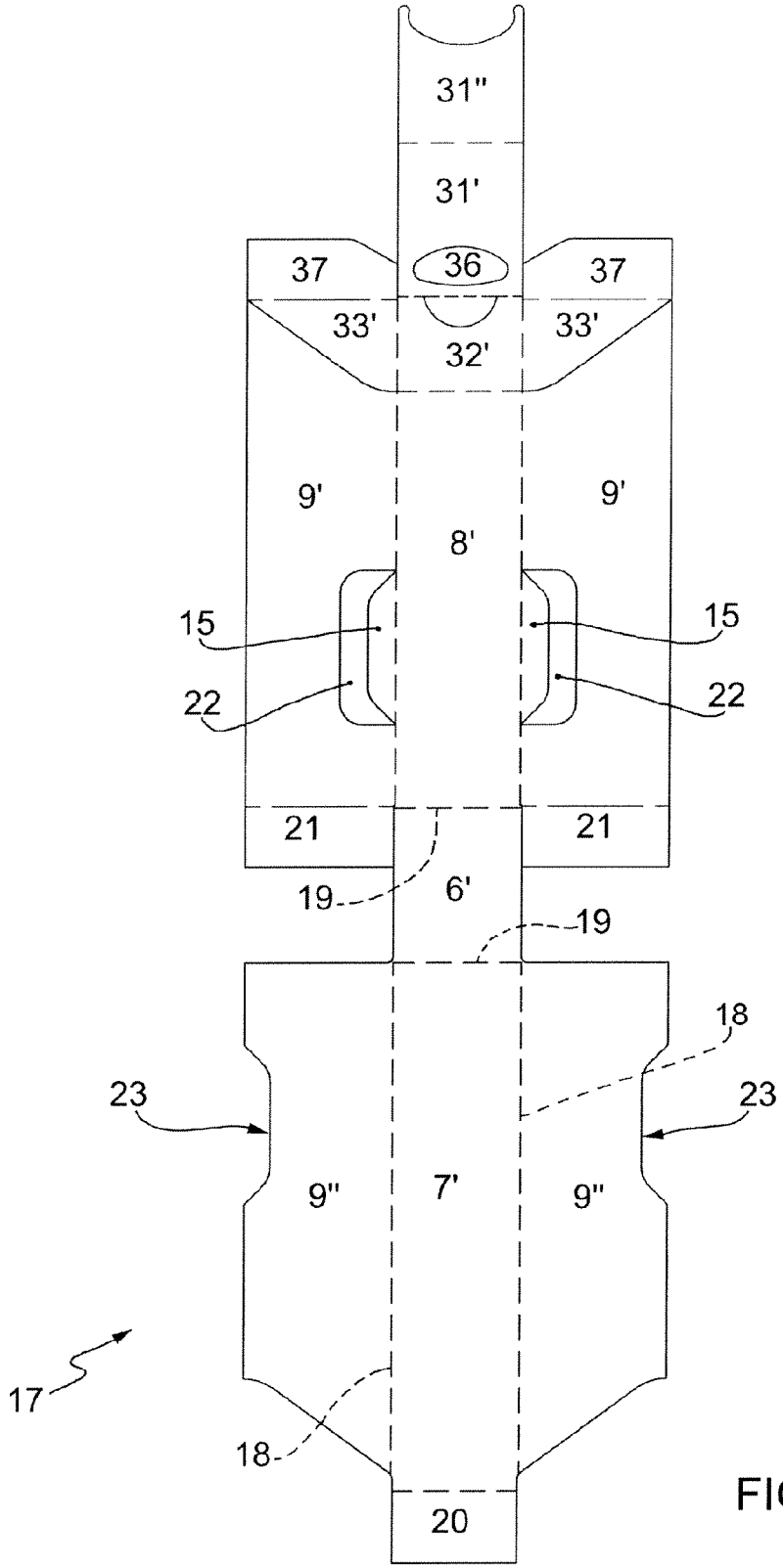

FIG. 17 shows a different flat blank 17 from which to form inner container 3 of the FIG. 11 packet 1 of cigarettes, and the component parts of which are indicated using the same reference numbers as for blank 17 in FIG. 8. The FIG. 17 blank 17 differs from blank 17 in FIG. 8 by comprising a further panel 3111 connected to panel 31' along a transverse fold line 19, and which is folded onto panel 31' to strengthen top wall 31 of lid 29.

Figure 18:
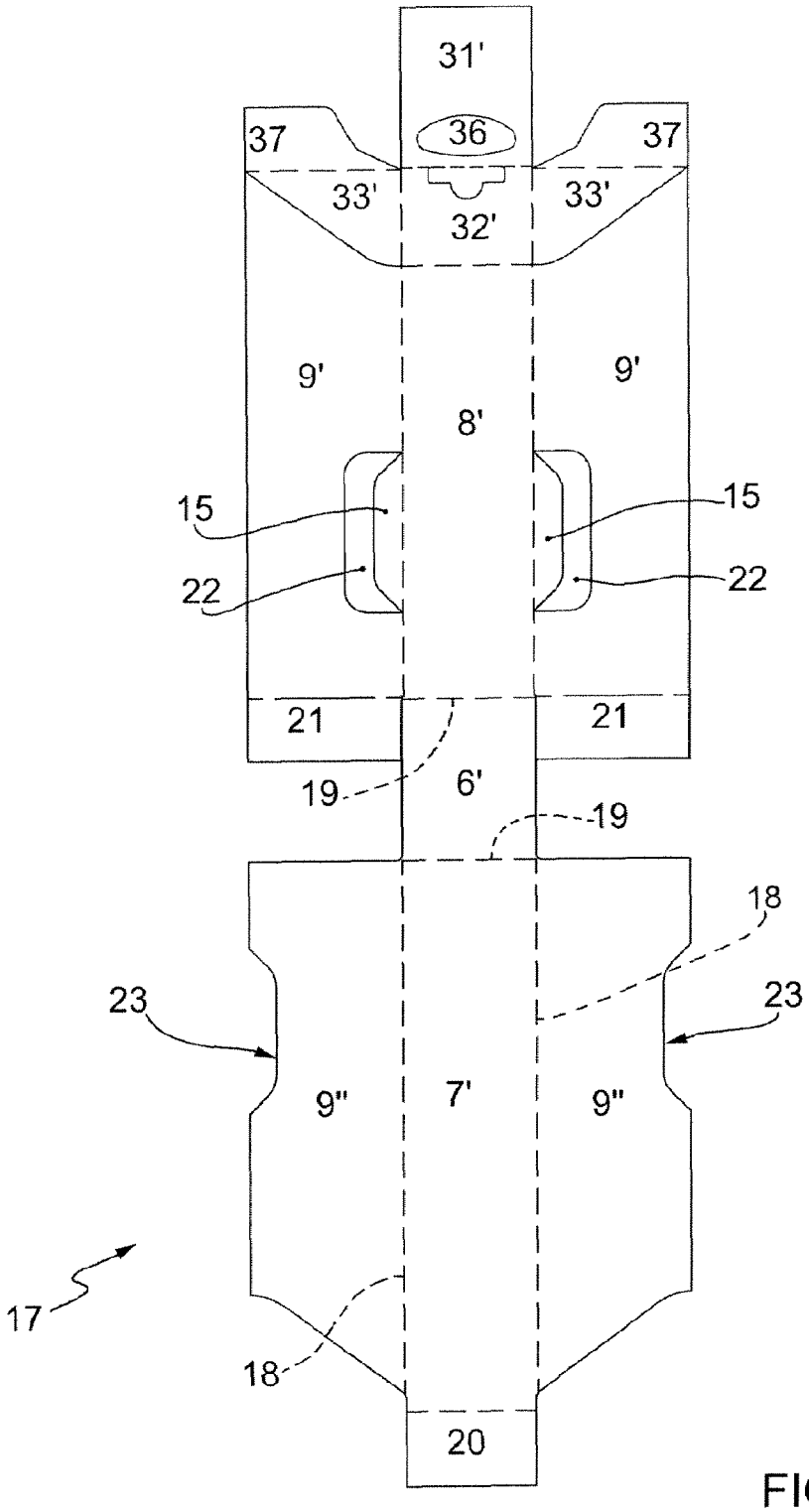

FIG. 18 shows a different flat blank 17 from which to form inner container 3 of the FIG. 11 packet 1 of cigarettes, and the component parts of which are indicated using the same reference numbers as for blank 17 in FIG. 8. The FIG. 18 blank 17 differs from blank 17 in FIG. 8 as regards the shape of tabs 37.

Figure 19:
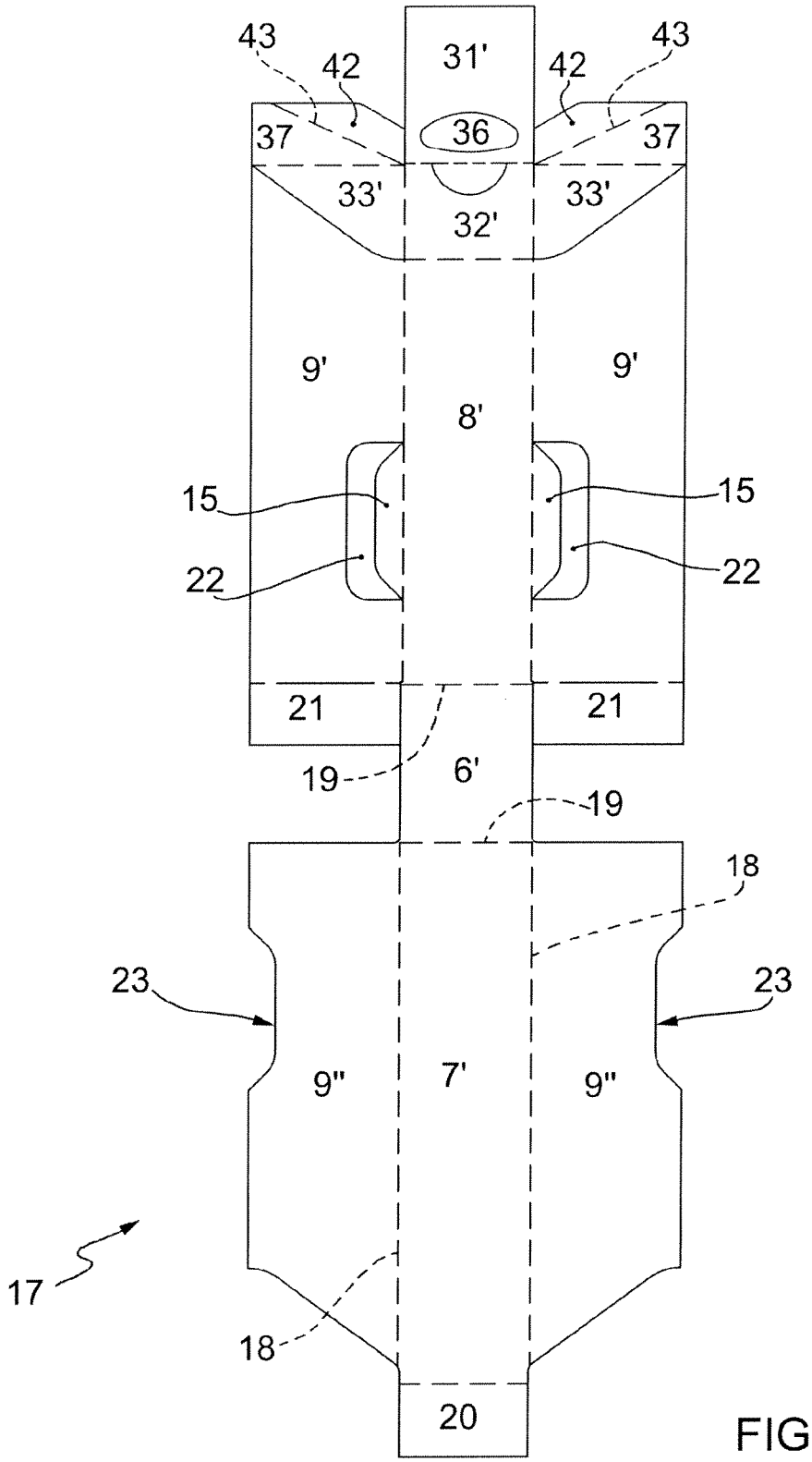

FIG. 19 shows a different flat blank 17 from which to form inner container 3 of the FIG. 11 packet 1 of cigarettes, and the component parts of which are indicated using the same reference numbers as for blank 17 in FIG. 8. The FIG. 19 blank 17 differs from blank 17 in FIG. 8 as regards tabs 37. More specifically, each tab 37 comprises an appendix 42, which is located close to panel 31' (i.e. close to top wall 31 of lid 29), is connected to tab 37 along an oblique fold line 43, and is folded 180° onto tab 37.

Figure 20:
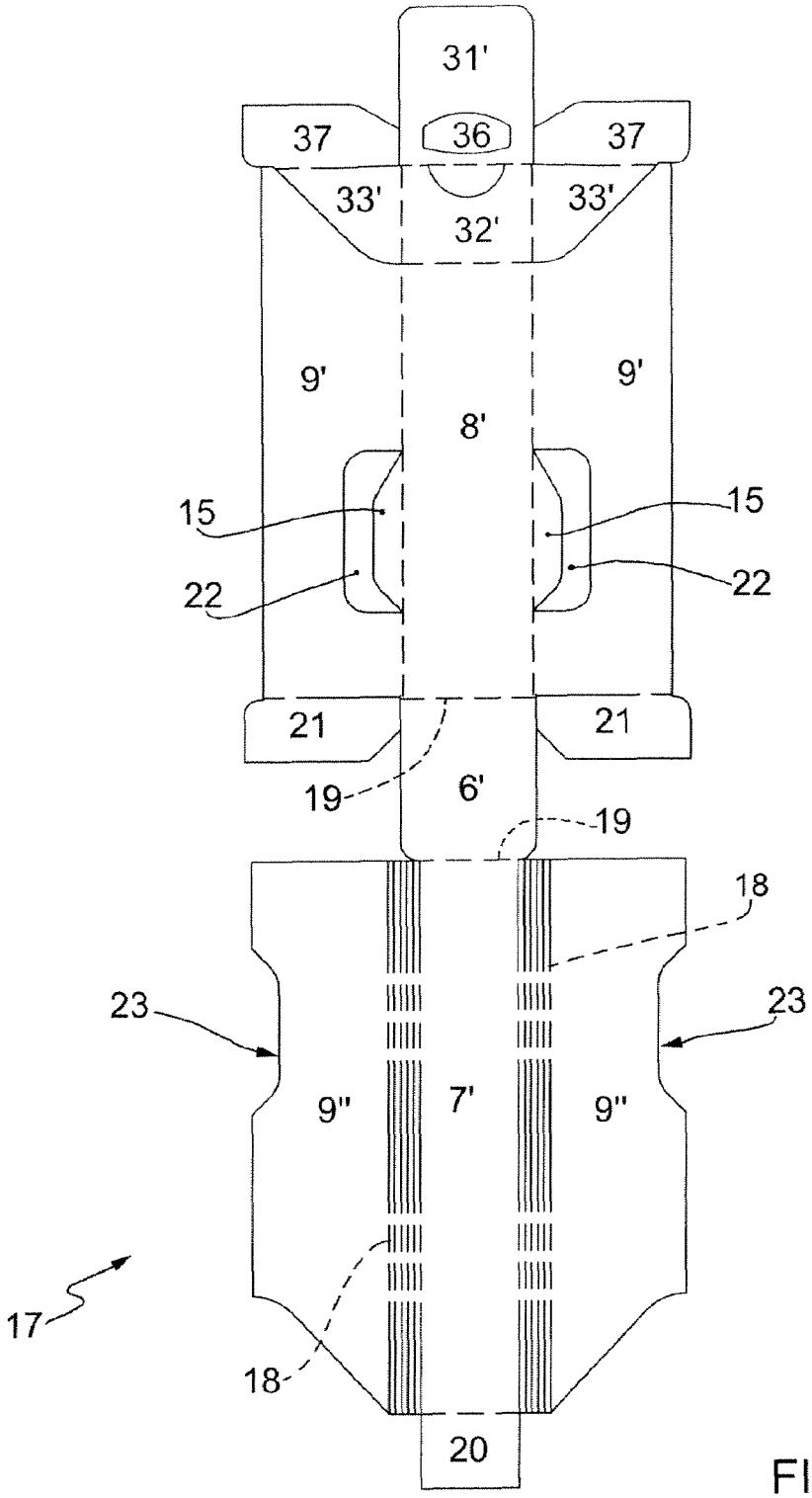
FIG. 20 shows a variation of the FIG. 16 blank to form an inner container with rounded longitudinal edges.

FIG. 20 shows a variation of the FIG. 16 blank 17 to form an inner container 3 with two rounded front longitudinal edges (i.e. on opposite sides of front wall 7).

Figure 21:
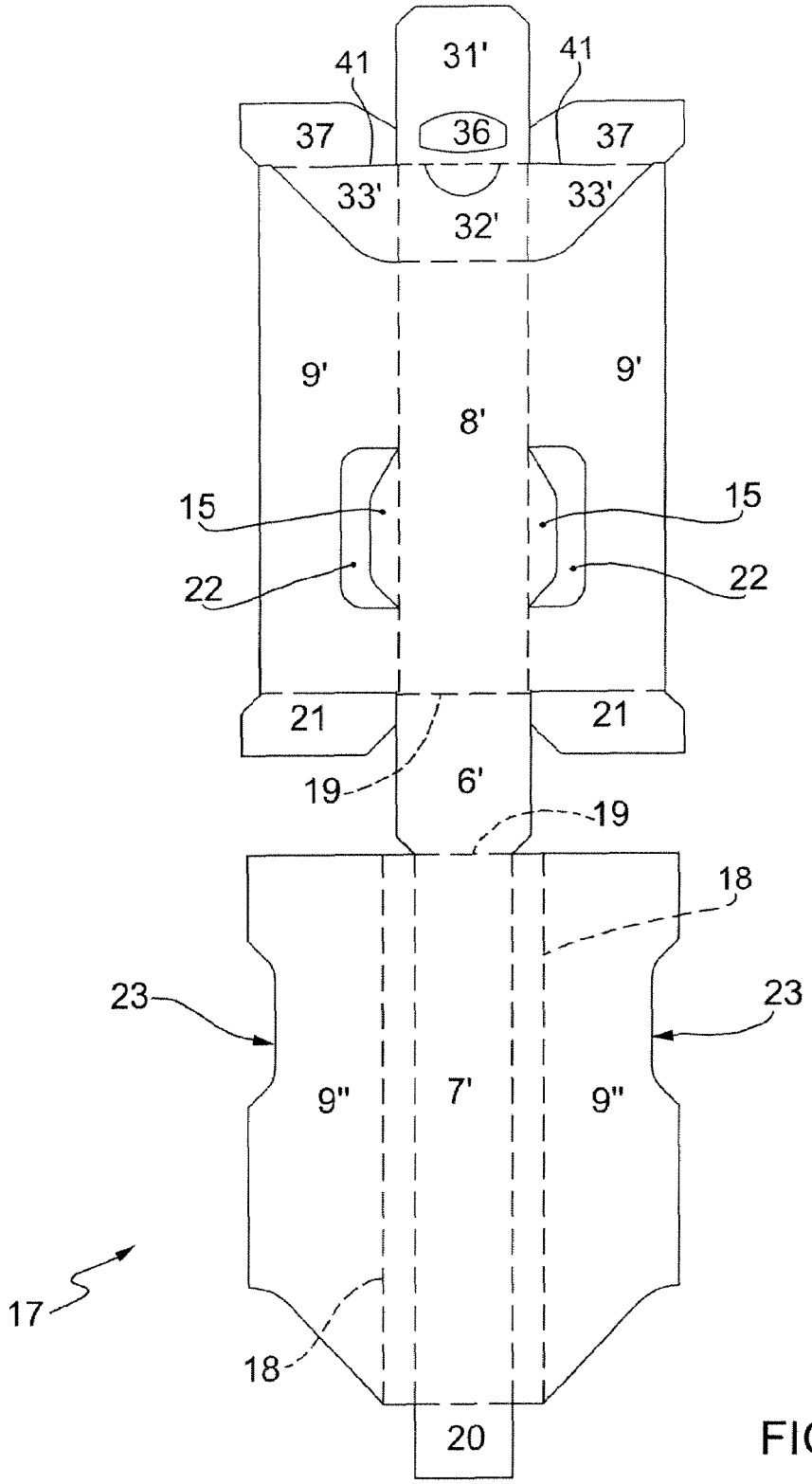
FIG. 21 shows a variation of the FIG. 16 blank to form an inner container with bevelled longitudinal edges.

FIG. 21 shows a variation of the FIG. 16 blank 17 to form an inner container 3 with two bevelled front longitudinal edges (i.e. on opposite sides of front wall 7).

In the embodiments shown in the attached drawings, the longitudinal and transverse edges of inner container 3 and outer container 4 are all square. Alternatively, the longitudinal and/or transverse edges of inner container 3 and outer container 4 may be non-square rounded or bevelled edges. Blanks 24 for forming outer container 4 with rounded or bevelled longitudinal edges are shown in FIGS. 13, 14, 15, and blanks 17 for forming inner containers with rounded or bevelled front longitudinal edges are shown in FIGS. 20 and 21.

Packet 1 of cigarettes as described herein has numerous advantages, by being easy to produce, and, above all, by making inner containers 3 extremely easy to open (i.e. extract from outer container 4).

The invention claimed is:

1. A rigid, swing-open packet of cigarettes comprising:

at least two groups (2) of cigarettes;

at least two inner containers (3), which are identical and each of which houses a group (2) of cigarettes, is parallelepiped- and cup-shaped, and has an open top end (5) from which the cigarettes are withdrawn, a bottom wall (6) opposite open top end (5), a front wall (7), a rear wall (8) opposite and parallel to front wall (7), and two opposite parallel lateral walls (9);

an outer container (4), which houses the inner containers (3), is parallelepiped-shaped, and has a top wall (10), a bottom wall (11) opposite and parallel to top wall (10), two opposite parallel lateral walls (12), and at least one open lateral end (13); and a hinge (14) connecting each inner container (3) and the outer container (4) to allow the inner container (3) to rotate between a closed position, in which the inner container (3) is inserted inside the outer container (4), and an open position, in which the inner container (3) is at least partly extracted from the outer container (4);

wherein each inner container (3) comprises a hinged lid (29) hinged to the inner container (3) along a lid hinge (30) to rotate, with respect to the inner container (3), between an open position and a closed position opening and closing the open top end (5) respectively;

wherein each lid (29) has an actuating system (34) which connects the lid (29) to the outer container (4) so that, when the inner container (3) is extracted from and inserted into the outer container (4), the lid (29) is connected to the outer container (4) to open and close the lid (29);

wherein each inner container (3) is formed by folding a flat first blank (17) and the outer container (4) is formed by folding a flat second blank (24);

wherein each hinge (14) is abutting a respective edge of the bottom wall (6) of the inner container (3) abutting a respective edge of the bottom wall (11) of the outer container (4) at the open lateral end (13) of the outer container (4); and wherein the outer container (4) has two opposite open lateral ends (13), through each of which an inner container (3) is extracted from or inserted into the outer container (4) into the open or closed position respectively, so that, in the closed position, the front wall (7) of each inner container (3) closes respective an open lateral end (13) of the outer container (4) completely.

2. A packet of cigarettes as claimed in claim 1, wherein the hinge (14) is located between an edge of a wall (6, 9) of the inner container (3) and an edge of a wall (11, 12) of the outer container (4) at the open lateral end (13) of the outer container (4).

3. A packet of cigarettes as claimed in claim 1, wherein the hinge (14) is located between an edge of a bottom wall (6) of the inner container (3) and an edge of a bottom wall (11) of the outer container (4) at the open lateral end (13) of the outer container (4).

4. A packet of cigarettes as claimed in claim 1, wherein a rear wall (8) of the inner container (3) is lower than a front wall (7) of the inner container (3).

5. A packet of cigarettes as claimed in claim 1, and comprising stop members for limiting extraction of the inner container (3) from the outer container (4).

6. A packet of cigarettes as claimed in claim 5, wherein the stop members comprise:

two retaining tabs (15) projecting outwards of the outer container (4) from the lateral walls (9) of the inner container (3), and abutting a rear wall (8) of the inner container (3); and two retaining pockets (16) projecting inwards of the outer container (4) from lateral walls (12) of the outer container (4), and abutting the open lateral end (13) of the outer container (4).

7. A packet of cigarettes as claimed in claim 1, wherein the lid hinge (30) connects a top edge of a rear wall (8) of the inner container (3) to a bottom edge of a rear wall (32) of the lid (29).

8. A packet of cigarettes as claimed in claim 7, wherein the lid (29) comprises a rectangular top wall (31) opposite and parallel to a bottom wall (6) of the inner container (3) when the lid (29) is in the closed position; a rectangular rear wall (32) forming an extension of a rear wall (8) of the inner container (3) when the lid (29) is in the closed position; and two triangular lateral walls (33) forming extensions of lateral walls (9) of the inner container (3) when the lid (29) is in the closed position.

9. A packet of cigarettes as claimed in claim 1, wherein the actuating system (34) comprises an actuating tab (35) extending inwards of the outer container (4) from an edge of a top wall (10) of the outer container (4); and a slot (36) formed through a top wall (31) of the lid (29), and which is engaged by the actuating tab (35).

10. A packet of cigarettes as claimed in claim 9, wherein the lid (29) comprises two tabs (37), which are folded onto the top wall (31) of the lid (29) and at least partly close the slot (36) from the inside.

11. A packet of cigarettes as claimed in claim 10, wherein the tabs (37) deform partly to allow the actuating tab (35) to engage the slot (36).

12. A packet of cigarettes as claimed in claim 10, wherein the tabs (37) are connected to lateral walls (33) of the lid (29) along fold lines (19).

13. A packet of cigarettes as claimed in claim 10, wherein each tab (37) has a bevelled corner, so as to leave the slot (36) partly open.

14. A packet of cigarettes as claimed in claim 1, wherein the inner container (3) is formed by folding a flat first blank (17) having two longitudinal fold lines (18), and a number of transverse fold lines (19) defining, between the two longitudinal fold lines (18), a first panel (8') forming a rear wall (8); a second panel (6') forming a bottom wall (6); and a third panel (7') forming a front wall (7).

15. A packet of cigarettes as claimed in claim 14, wherein the third panel (7') has a reinforcing flap (20) connected to the third panel (7') along a transverse fold line (19), and which is folded 180° onto the third panel (7') to strengthen the top portion of the front wall (7).

16. A packet of cigarettes as claimed in claim 14, wherein the first panel (8') has two first lateral wings (9'), which form respective inner portions of the lateral walls (9), are located on opposite sides of the first panel (8'), and are separated from the first panel (8') by the longitudinal fold lines (18); and the third panel (7') has two second lateral wings (9"), which form respective outer portions of the lateral walls (9), are located on opposite sides of the third panel (7'), and are separated from the third panel (7') by the longitudinal fold lines (18).

17. A packet of cigarettes as claimed in claim 16, wherein each first lateral wing (9') of the first panel (8') has a tab (21) separated from the first lateral wing (9') by a transverse fold line (19).

18. A packet of cigarettes as claimed in claim 16, wherein a window (22) is formed in each first lateral wing (9') and contains a respective retaining tab (15); and each second lateral wing (9") has a recess (23) located so as to be superimposed over a respective retaining tab (15).

19. A packet of cigarettes as claimed in claim 1, wherein the outer container (4) is formed by folding a flat second blank (24) having two longitudinal fold lines (25), and a number of transverse fold lines (26) defining, between the two longitudinal fold line (25), a first panel (11') forming an inner portion of a bottom wall (11); a second panel (12') forming a lateral wall (12); a third panel (10') forming a top wall (10); a fourth panel (12") forming another lateral wall (12); and a fifth panel (11") forming an outer portion of the bottom wall (11).

20. A packet of cigarettes as claimed in claim 19, wherein the third panel (10') has two reinforcing flaps (27), which are located on opposite sides of the third panel (10'), are separated from the third panel (10') by the longitudinal fold lines (25), and are folded 180° onto the third panel (10') to strengthen the top wall (10).

21. A packet of cigarettes as claimed in claim 19, wherein the second panel (12') and the fourth panel (12") each have two retaining pockets (16), which are located on opposite sides of the relative panel (12', 12"), are separated from the relative panel (12', 12") by the longitudinal fold lines (25), and are folded 180° onto the relative panel (12', 12").

22. A packet of cigarettes as claimed in claim 19, wherein the first panel (11') has two connecting tabs (28), which are located on opposite sides of the first panel (11'), are separated from the first panel (11') by the longitudinal fold lines (25), and are folded 180° onto the first panel (11'); and each connecting tab (28)is glued to a bottom wall (6) of a respective inner container (3) to hinge the inner container (3) to the outer container (4).

23. A packet of cigarettes as claimed in claim 1, wherein the inner container (3) is hinged to the Outer container (4) by a connecting tab (28), which is hinged to the outer container (4) along the hinge (14) and glued to a bottom wall (6) of the inner container (3).

24. A packet of cigarettes as claimed in claim 23, wherein the connecting tab (28) is further glued to a bottom wall (11) of the outer container (4) using non-setting, re-stick adhesive.

25. A packet of cigarettes as claimed in claim 23, wherein the connecting tab (28) is further glued to a bottom wall (11) of the outer container (4) using weak-stick adhesive which releases its hold the first time the inner container (3) is extracted.

26. A packet of cigarettes as claimed in claim 1, wherein the inner container (3) is hinged to the outer container (4) by a connecting tab (28), which is hinged to the inner container (3) along the hinge (14) and further glued to a bottom wall (11) of the outer container (4).

27. A packet of cigarettes as claimed in claim 26, wherein the connecting tab (28) is glued to a bottom wall (6) of the inner container (3) using non-setting, re-stick adhesive.

28. A packet of cigarettes as claimed in claim 26, wherein the connecting tab (28) is glued to a bottom wall (6) of the inner container (3) using weak-stick adhesive which releases its hold the first time the inner container (3) is extracted.

29. A packet of cigarettes as claimed in claim 1, and comprising a retaining member for holding the inner container (3) in the closed position.

* * * * *

UNITED STATES PATENT AND TRADEMARK OFFICE

CERTIFICATE OF CORRECTION

PATENT NO. : 7,712,607 B2
APPLICATION NO. : 12/172643
DATED : May 11, 2010
INVENTOR(S) : Marco Ghini et al.

It is certified that error appears in the above-identified patent and that said Letters Patent is hereby corrected as shown below:

On the Title Page:

Item (73), "Societ a′per" should be -- Societa′ per --.

Item (30), "08153811" should be -- 08153811.8 --.

In the Claims:

At Column 10, line 38, "Outer" should be -- outer --.

Signed and Sealed this

Twelfth Day of October, 2010

David J. Kappos

David J. Kappos
*Director of the United States Patent and Trademark Office*